US006241581B1

(12) United States Patent
Miyashita et al.

(10) Patent No.: US 6,241,581 B1
(45) **Date of Patent: *Jun. 5, 2001**

(54) METHOD FOR DRESSING A POLISHING PAD, POLISHING APPARATUS, AND METHOD FOR MANUFACTURING A SEMICONDUCTOR APPARATUS

(75) Inventors: Naoto Miyashita, Yokohama; Yoshihiro Minami, Tokyo, both of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/055,944

(22) Filed: Apr. 7, 1998

(30) Foreign Application Priority Data

Apr. 10, 1997 (JP) ..... 9-106804

(51) Int. Cl.[7] ..... B24B 1/00

(52) U.S. Cl. ..... 451/41; 451/56; 451/57; 451/63

(58) Field of Search ..... 451/56, 41, 57, 451/63

(56) References Cited

U.S. PATENT DOCUMENTS 5,902,173 * 5/1999 Tanaka ..... 451/41

* cited by examiner

*Primary Examiner*—M. Rachuba
(74) *Attorney, Agent, or Firm*—Finnegan, Henderson, Farabow, Garrett & Dunner, L.L.P.

(57) ABSTRACT

A dresser is used which makes it possible to simultaneously dress and condition the surface of a polishing pad deteriorated by polishing a semiconductor wafer in the CMP process. The dresser is a dresser comprised of a ceramic such as dressing SiC, SiN, alumina or silica. Use of this dresser enables to shorten the time of dressing/conditioning the deteriorated polishing pad.

6 Claims, 11 Drawing Sheets

DUSTS ON SILICON WAFER SURFACE

| | DUSTS |
|---|---|
| NON-DRESSING | 188 |
| CERAMIC DRESSING | 39 |

DISHING AMOUNT OF POLISMING PAD

| | DISHING AMOUNT(nm) |
|---|---|
| NON-DRESSING | 120 |
| CERAMIC DRESSING | 170 |

METHOD FOR DRESSING A POLISHING PAD, POLISHING APPARATUS, AND METHOD FOR MANUFACTURING A SEMICONDUCTOR APPARATUS

BACKGROUND OF THE INVENTION

The invention relates to a chemical mechanical polishing (CMP) process which is used for flattening an insulated layer embedded in a trench and an interlayer dielectric in a multi-layer wiring process, in particular relates to a dresser which makes it possible to dress and condition a polishing pad surface deteriorated by polishing treatment, and a method for dressing a polishing pad by using this dresser.

Hitherto, the CMP process used for a semiconductor apparatus has been used for flattening a thin layer, for example, an insulated layer or a metal layer formed on a semiconductor wafer by CVD or the like.

The CMP process is a process for making a thin layer on the surface of a semiconductor wafer flat by infiltrating a polishing material containing polishing particles, which is referred to as a slurry, into a polishing pad set up on a polishing plate and rotating the polishing pad accompanied with rotation of the polishing plate to polish the semiconductor wafer with the rotating polishing pad. Polishing many wafers by this process, i.e., carrying out polishing treatment of wafers many times, results in a problem that the surface of the polishing pad becomes rough to be deteriorated. Hitherto, surface-treatment, referred to as dressing, has been conducted, in order to restore the rough surface to the initial condition thereof as much as possible.

In the CMP process which is used for manufacturing a semiconductor apparatus, polishing is carried out under a condition that a polishing material is present between the polishing pad and the semiconductor wafer. A material for the polishing pad used for polishing includes various materials. A material which is commonly used is a polyurethane foam. The polishing pad composed of the polyurethane foam has in the surface thereof a large number of fines bores, and keeps a polishing material in the bores to enable polishing. However, if the polishing treatment of a semiconductor wafer is conducted many times in application of the CMP process to manufacture a semiconductor apparatus, reaction products and particles of the polishing material are gradually pressed against the inner portions of the bores so that they are confined into the bores. Polishing under such a condition causes a polishing rate and uniformity from polishing to be decreased.

When the urethane foam is used for the polishing pad, an initial treatment is necessary which is for making the surface of the polishing pad rough to some extent at the start of use of the pad and which is called conditioning. Making the surface rough by this treatment is indispensable for obtaining a stable polishing rate and uniformity from polishing.

It is known that the polishing pad is remarkably deteriorated by adding, into the polishing material, a material having a high viscosity such as a high molecular surfactant or a polysaccharide besides polishing particles. Attention has been paid to a serious problem that use of such a deteriorated polishing pad causes drop in a yield rate in the CMP process for a semiconductor device wafer in which fine patterns are formed at a high density.

Hitherto, treatment for setting a pad, which is referred to dressing, has been conducted to remove off an alien substance with which the bores are blocked and scrape off a rough surface of the pad. For the dressing, there is usually used a diamond dresser in which diamond particles are incorporated into a resin or on which diamond particles are electrodeposited. The diamond dresser makes it possible to remove off the alien substance substantially completely because of scraping off the surface layer of the polyurethane foam; however, it causes the surface state of the polishing pad to be returned to the surface state before being subjected to the initial treatment. Therefore, unless after the dressing treatment the pad is conditioned to make the surface thereof rough, it is impossible to reproduce a stable polishing rate and uniformity form polishing. A silicon wafer may be used for the conditioning. Specifically, the polishing pad may be conditioned by polishing the silicon wafer with the polishing pad for about 60 minutes, i.e., the dummy-polishing treatment with the silicon wafer. Much time is spent on the dummy-polishing treatment with the silicon wafer. Consequently, hitherto a decline in productivity in this process has been a serious problem.

BRIEF SUMMARY OF THE INVENTION

The present invention has been accomplished on the basis of such a situation. The object of the present invention is to provide a method for dressing a polishing pad, a polishing apparatus, and a method for manufacturing a semiconductor apparatus which make it possible to prevent productivity-drop resulted from conditioning treatment of a polishing pad deteriorated by polishing the surface of a semiconductor wafer in the CMP process.

The object of the present invention is to provide a method for dressing a polishing pad, a polishing apparatus, and a method for manufacturing a semiconductor apparatus which make it possible to reduce dust with dishing being controlled, make the life of the polishing pad longer and stabilize a polishing rate.

The first feature of a method for dressing a polishing pad according to the present invention comprise the steps of: polishing at least one semiconductor wafer, in which a polishing material containing polishing particles is applied to a polishing surface of the semiconductor wafer while the semiconductor wafer is polished with the polishing pad;

and dressing the surface of the polishing pad deteriorated by polishing the semiconductor wafer, with a ceramic dresser. The second feature of a method for dressing a polishing pad according to the present invention comprises the steps: dressing a used surface of the polishing pad with a diamond dresser; dressing with a ceramic dresser the surface of the polishing pad treated with the diamond dresser; polishing at least one semiconductor wafer, in which a polishing material containing polishing particles is applied to a polishing surface of the semiconductor wafer while the semiconductor wafer is polished with the polishing pad; and dressing the surface of the polishing pad deteriorated by polishing at least one semiconductor wafer, with the ceramic dresser.

The invention may further comprise the step of dressing the polishing pad again with the ceramic dresser, after the deteriorated polishing pad restored by using the ceramic dresser is deteriorated by polishing the semiconductor wafer. The polishing pad may be dressed with the diamond dresser, after conducting the above-mentioned dressing step with the ceramic dresser plural times. The polishing pad dressed with the diamond dresser may be dressed with the ceramic dresser for restoration, before the polishing pad is used for a further polishing treatment. The surface of the ceramic dresser may have at least one step.

The polishing apparatus according to the present invention comprises: a polishing pad for polishing a semiconductor wafer; a means for supplying a polishing material to the polishing pad; a polishing plate driven by a driving shaft, in which the polishing pad is disposed on the surface of the polishing plate; and a ceramic dresser disposed so as to be pressed against the polishing pad. A diamond dresser may be further fitted up. The apparatus may have a controlling unit for controlling the rotating number of the ceramic dresser and the press pressure of the ceramic dresser against the polishing pad.

The method for manufacturing a semiconductor apparatus according to the invention comprises step: arranging a polishing pad on a polishing plate of a polishing apparatus; giving plural semiconductor wafers the treatment of applying a polishing material containing polishing particles to respective polishing surfaces of the semiconductor wafers while polishing respective films to be polished on the respective polishing surfaces, with the polishing pad; and dressing with a ceramic dresser the surface of the polishing pad deteriorated by polishing the respective films to be polished of the plural semiconductor wafers. The polishing pad may be rotated by rotation of the polishing plate, and the semiconductor wafers may be polished while they are pressed against the rotating polishing pad. The respective semiconductor wafers may be removed off from the polishing pad, and subsequently the ceramic dresser may be pressed against the rotating polishing pad to dress the polishing pad. The ceramic dresser may be pressed against the polishing pad when the respective semiconductor wafers are pressed against the polishing pad, thereby carrying out the dressing treatment accompanied with the polishing treatment.

The ceramic dresser and the diamond dresser may be pressed against the polishing pad when the respective semiconductor wafers are pressed against the polishing pad, thereby carrying out the dressing treatment with the ceramic dresser and the dressing treatment with the diamond dresser accompanied with the polishing treatment. Pure water may be supplied to the polishing pad when the respective films to be polished are polished. An additive for controlling dishing may be supplied to the polishing pad when the respective films to be polished are polished. The additive for controlling dishing may comprise a hydrophilic polysaccharide.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
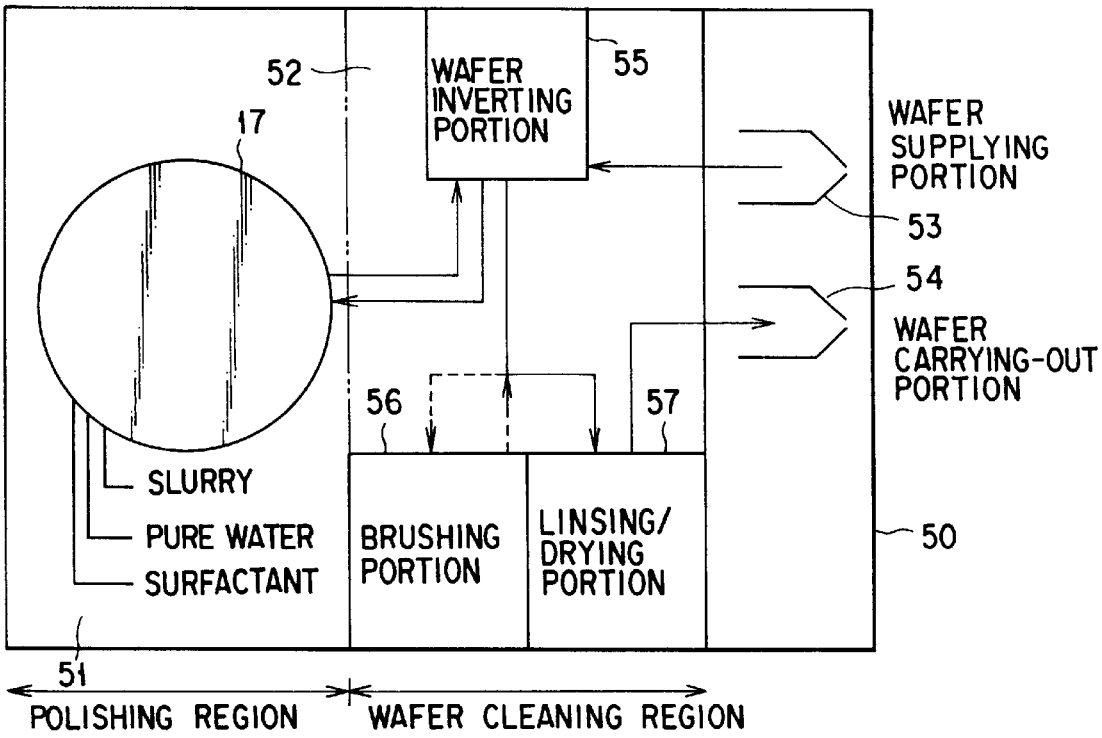
FIG. 1 is a block diagram of a semiconductor manufacturing apparatus including a polishing apparatus according to the present invention.

Referring to the drawings, embodiments of the present invention will be described below.

The present invention relates to a process for treating a wafer in manufacturing a semiconductor apparatus. FIG. 1 is a schematic view of a semiconductor manufacturing apparatus for applying a sequence from polishing using a CMP apparatus (a polishing apparatus) to in-line washing to a semiconductor wafer. The semiconductor manufacturing apparatus 50 is divided into a polishing region 51 and a wafer cleaning region, and further has a wafer supplying portion 53 for supplying a semiconductor wafer to the apparatus 50 and a wafer carrying-out portion for receiving the semiconductor wafer treated in the apparatus 50 and carrying it outside. In the polishing area 51, the semiconductor wafer such as a silicon wafer is polished with a polishing pad (not illustrated) set up on a polishing plate 17, which may called a turn table. In polishing treatment, a polishing material referred to as slurry, pure water, and an additive are supplied to the polishing pad. The semiconductor wafer to be polished with the polishing pad is forwarded from the wafer supplying portion 53 to a wafer inverting portion 55 in the wafer cleaning area 52, is inverted, that is, is turned over so that the right side (i.e., the surface) thereof will face down, and is preserved temporarily. Subsequently, the wafer is forwarded to the polishing plate 17.

The semiconductor wafer polished with the polishing pad is returned to the wafer inverting portion 55 and is inverted, that is, is turned over so that the right side will face up. The semiconductor wafer is then forwarded from this portion 55 to a brushing portion 56 to be subjected to brushing treatment, and further forwarded to a rinsing/drying portion 57 to be washed and dried. After that, the semiconductor wafer is forwarded to the wafer carrying-out portion 54, and carried outside from the apparatus 50 to be subjected to the following step from the wafer carrying-out portion 54. As the polishing pad is used to treat semiconductor wafers repeatedly, the polishing pad is deteriorated in its surface condition so that its polishing property gradually becomes bad. Therefore, it is necessary to restore the polishing property by dressing or conditioning the deteriorated polishing pad.

Figure 2:
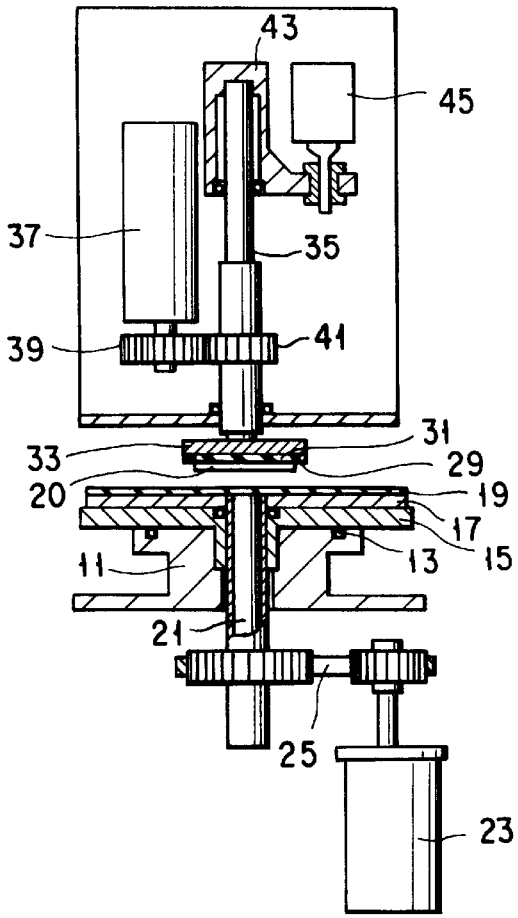
FIG. 2 is a cross section of the polishing apparatus which is used in the semiconductor manufacturing apparatus shown in FIG. 1.

Referring to FIG. 2, the following will describe a polishing apparatus which is used for the semiconductor manufacturing apparatus illustrated in FIG. 1. FIG. 2 is a schematically cross section of a polishing apparatus for CMP which is used for the apparatus manufacturing apparatus shown in FIG. 1. A polishing plate receiver 15 is disposed on a support 11 through bearings 13. A polishing plate 17 is set up on the polishing plate receiver 15. A polishing pad 19 for polishing the semiconductor wafer is stuck on the polishing plate 17. A driving shaft 21 is connected to the polishing plate receiver 15 and the polishing plate 17 so as to penetrate into the central portions of them for the purpose of rotating them. This driving shaft 21 is rotated through a rotating belt 25 by a motor 23. On the contrary, an adsorbing disc 33 for adsorbing the semiconductor wafer 20 is disposed above the polishing pad 19 to oppose the pad 19. A template 29 and an adsorbing cloth 31 are fitted up on the surface of the adsorbing disc 33. The semiconductor wafer 20 is adsorbed on the adsorbing cloth 31 on the adsorbing disc 33 by, for example, vacuum adsorption, so that the adsorbed semiconductor wafer 20 is positioned above the polishing pad 19 to oppose the pad 17. The adsorbing disc 33 is connected to a driving shaft 35, which is rotated through gears 39 and 41 by a motor 37, and which is set up rotatably to a supporter 43. The supporter 43 is connected to a cylinder 45 and moved up and down accompanied with the movement of the cylinder 45 in upper and lower directions.

In the above-mentioned structure, when the supporter 43 is moved up or down by driving of the cylinder 45, the semiconductor wafer 20 fixed on the adsorbing disc 33 is pressed against the polishing pad 10 or is pull off from the polishing pad 19, accordingly. The semiconductor wafer 20 is polished with the rotating polishing pad 19 while a polishing material is supplied between the semiconductor wafer 20 and the polishing pad 19.

The semiconductor wafer can be moved in the X-Y direction, i.e., in the horizontal direction by another driving unit during polishing, which is not shown in FIG. 2.

For example, in the case of polishing a polysilicon film embedded in a trench with use of a silicon oxide film as a stopper film, an example of a polishing sequence will be in the following. The sort of the slurry varies dependently on the sorts of a film to be polished on the semiconductor wafer, such as a polysilicon film.

(1) A slurry which makes a rate for polishing an oxide film high is supplied to the semiconductor wafer from a mixing valve not illustrated, in order to remove off a naturally oxidized film on the polysilicon film.

(2) After removing off the naturally oxidized film, supply of the slurry used in the step (1) is stopped, and subsequently a slurry which makes a rate for polishing a silicon oxide film high is supplied to the semiconductor wafer. As a material for the slurry, e.g., an organic amine based colloidal silica slurry may be used. When the polishing advances so that the oxide film stopper is exposed, the polishing is stopped.

(3) When the oxide film is exposed, the supply of the slurry for polishing the polysilicon film is stopped and then a surfactant for treating the surface of the wafer is added to the wafer.

(4) The supply of the surfactant is stopped, and then the surface of the wafer is rinsed with pure water, after which the wafer is forwarded to a washing step.

(5) The surface of the polishing pad is dressed to remove off the slurry attached onto the surface of the polishing pad. This treatment causes the attached slurry to be removed off so as to enable restoring a good polishing property.

However, if this treatment is conducted repeatedly, deterioration of the surface of the polishing pad advances so that the polishing pad will fall into a condition that a good polishing property cannot be restored by only a ceramic dresser. To avoid to fall into this condition, the surface of the pad is scraped away with a diamond dresser the surface of which has sharp tips every time after each dressing step, or every time after many dressing steps.

(6) The surface of the pad after the use of the diamond dresser is substantially restored into the state before the initial treatment.

So far, the surface of the polishing pad has been conditioned by dressing the pad with the diamond dresser as described above and then applying from 6 to 10 dummy silicon wafers to the polishing pad (for about 10 minutes per silicon wafer); however, according to the present invention, merely by dressing the polishing pad with the diamond dresser as described above and then dressing the pad with the ceramic dresser for several minutes, the surface of the polishing pad can be conditioned into the same condition as that accomplished by application of several ten dummy silicon wafers. Thus, the surface of the polishing pad can be made into the same condition as that accomplished by the prior art. The CMP process can be resumed after the conditioning either in the prior art or in the present invention.

Figure 3:
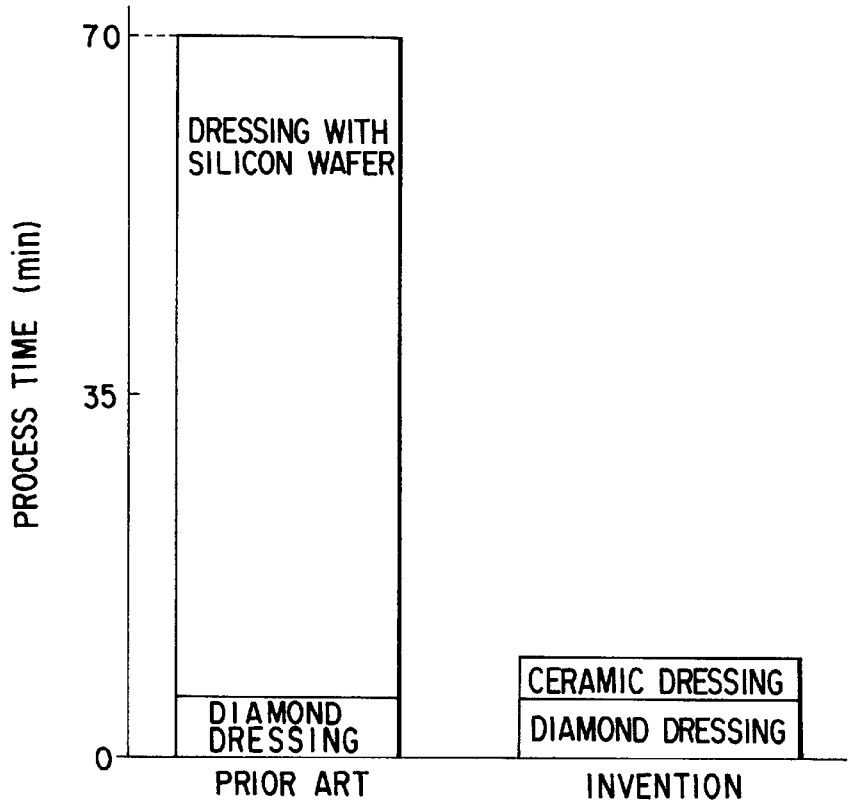
FIG. 3 is a diagram for explaining the polishing/dressing treatment according to the present invention.

FIG. 3 is a view for explaining the effect and advantage of the present invention, in comparison with the prior art, and shows difference between the dressing/conditioning treatment of a polishing pad before being used (i.e., a virgin pad) according to the present invention and that according to the prior art. The vertical axis shows time for treating the polishing pad (minute per polishing pad). In the prior art, before the wafer is polished, the dressing with diamond is conducted and then the dummy dressing (conditioning) with the silicon wafer is conducted. On the other hand, in the present invention, the dressing with diamond is conducted and subsequently the dressing (dressing/conditioning) with a ceramic is conducted. Time for the dressing treatment is 70 minutes per pad in the prior art, but that is only about 10 minutes per pad in the present invention. Such soft dressing with the ceramic dresser makes it possible to condition the polishing pad for a shorter time without dummy dressing (conditioning) with use of the silicon wafer.

Figure 4:
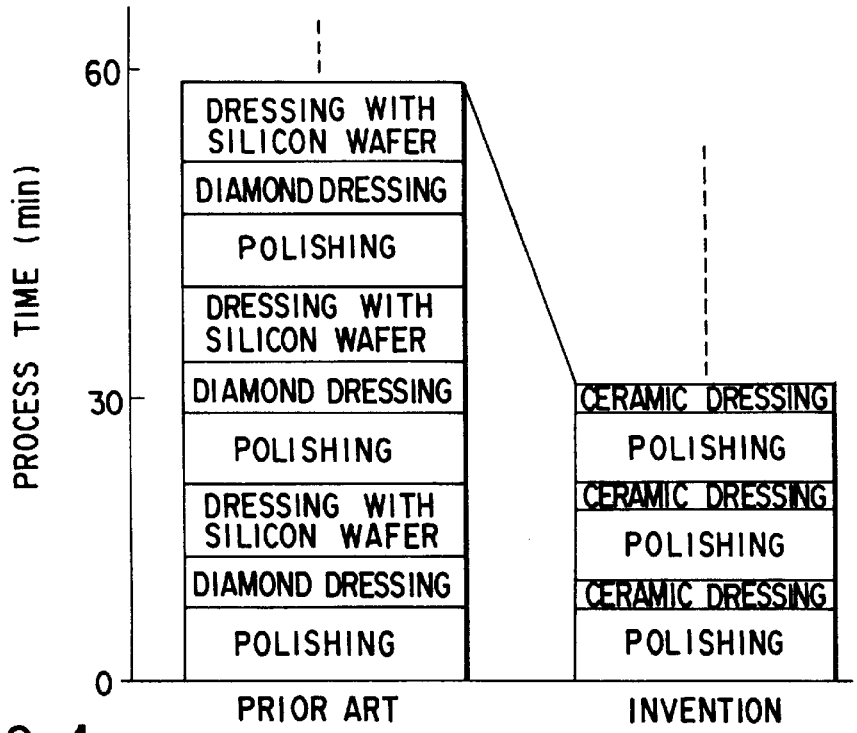
FIG. 4 is another diagram for explaining the polishing/dressing treatment according to the present invention.

FIG. 4 is a view of explaining the effect and advantage in continuous treatment according to the invention, and that according to prior art. As shown in FIG. 4, in the continuous treatment, polishing, diamond-dressing, and silicon wafer-dummy dressing (conditioning) are repeated according to the prior art, while polishing and ceramic-dressing (conditioning/dressing) are repeated according to the invention. As also shown in FIG. 4, the treating time by the invention is half as long as that by the prior art.

Figure 5:
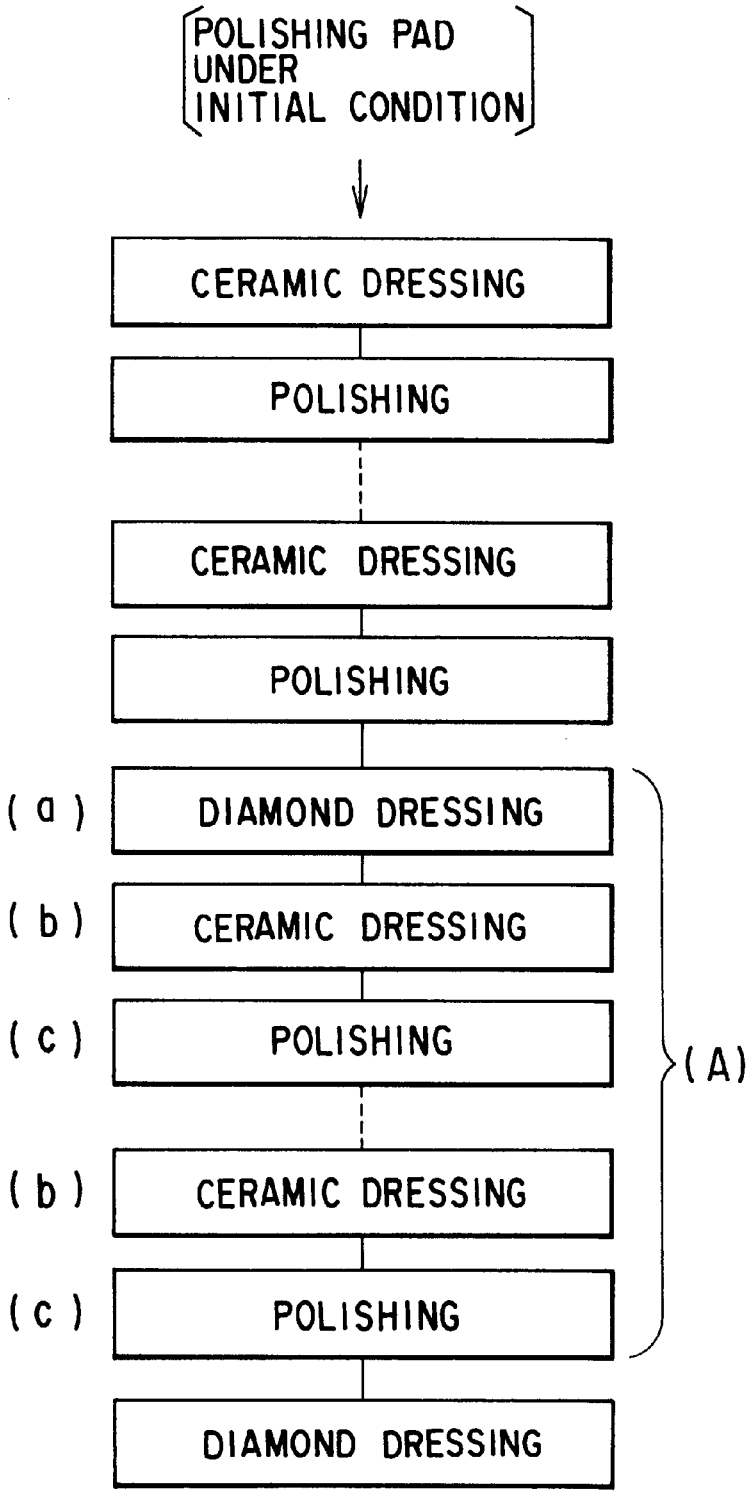
FIG. 5 is a flowchart for explaining the dressing treatment according to the invention.

The following will describe the first embodiment relating to a method for dressing a polishing pad, referring to FIG. 5. This embodiment relates to treatment for dressing a polishing pad which has never been used, i.e., a polishing pad under an initial condition. FIG. 5 is a flowchart of polishing and dressing, which is in accordance with the passage of time. It is necessary to condition the polishing pad which has never been used and are made from a polyurethane foam, because it has the same rough surface state as that after being diamond-dressed. The ceramic dresser according to the present invention can serve both as dressing and conditioning treatments.

At first, the polishing pad which has never been used is dressed with the ceramic dresser (i.e., ceramic-dressing). With this polishing pad, for example, from one to six silicon wafers are polished (i.e., wafer-polishing). The ceramic-dressing/wafer-dressing is repeated plural times.

(a) This polishing pad is then dressed with a diamond dresser (diamond-dressing). (b) Subsequently, the polishing pad is dressed with the ceramic dresser (ceramic-dressing). (c) One or more silicon wafers are polished with this polishing pad. The ceramic-dressing/polishing (b/c) is repeated plural times. Herein, the sequence including the diamond-dressing step (a) and the repeated ceramic-dressing/polishing steps (b) and (c) is abbreviated to the process A. The A process is carried out one or more times.

Figure 6:
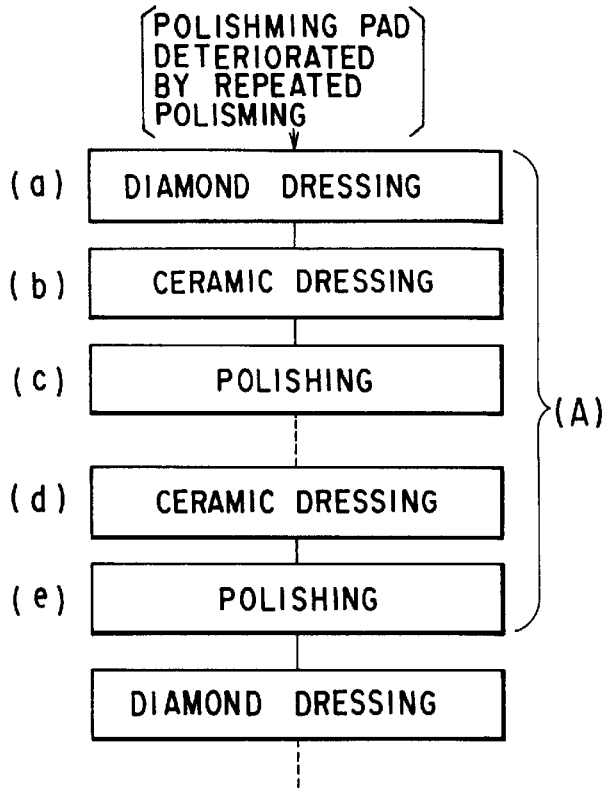
FIG. 6 is another flowchart for explaining the dressing treatment according to the invention.

The above is a polishing/dressing sequence in the case of using a polishing pad which has never been used. The following will describe the second embodiment relating to a method for dressing a polishing pad, referring to FIG. 6. This embodiment is concerned with a method for dressing a polishing pad having a polishing performance deteriorated by repeated polishing.

At first, the polishing pad whose polishing performance is deteriorated is dressed with a diamond dresser (diamond-dressing). This polishing pad is then dressed with a ceramic dresser (ceramic-dressing/conditioning). One or more silicon wafers are polished with this polishing pad. The ceramic-dressing/polishing is repeated plural times. After that, this polishing pad is again subjected to ceramic-dressing, and subsequently one or more silicon wafers are polished. This sequential process (shown in FIG. 5A) is carried out one or more times.

Referring to FIGS. 7A and 7B, and FIGS. 8A and 8B, a dresser which may be used in embodiments of the present invention will be explained in the following. FIGS. 7A and 7B, and FIGS. 8A and 8B are cross sections of dressers, respectively. A ceramic dresser 22 shown in FIG. 7A comprises a ceramic made by sintering alumina, silicon nitride, silicon carbide or the like at a high temperature, and has a shape of, for example, a disc. Its first principal face constitutes a dressing face 221 for dressing a polishing pad. If the dressing face has at least one step, polishing efficiency is raised. The step has a height from about 20 to 30 nm. The ceramic dresser 22 is operated by a supporting arm 222 fixed on a principal face opposite to the dressing face 221.

Figure 7A:
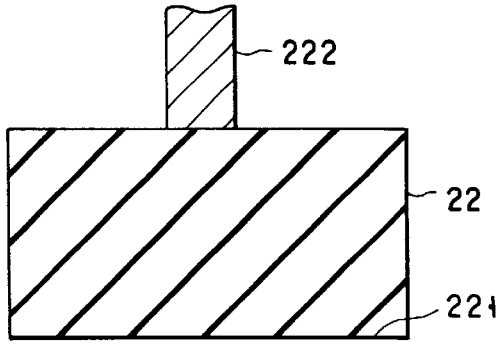
FIGS. 7A and 7B are cross sections of a dresser used in the dressing treatment according of the invention, respectively.
Figure 7B:
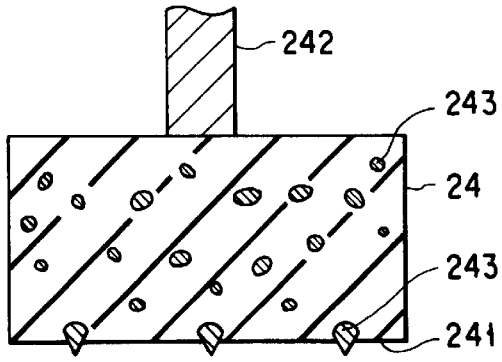
Figure 8A:
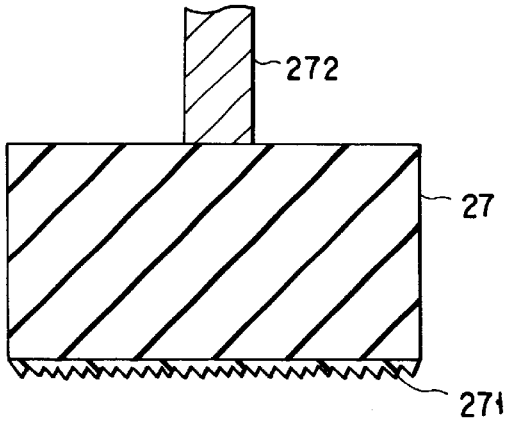
FIGS. 8A and 8B are cross sections of a dresser used in the dressing treatment according of the invention, respectively.
Figure 8B:
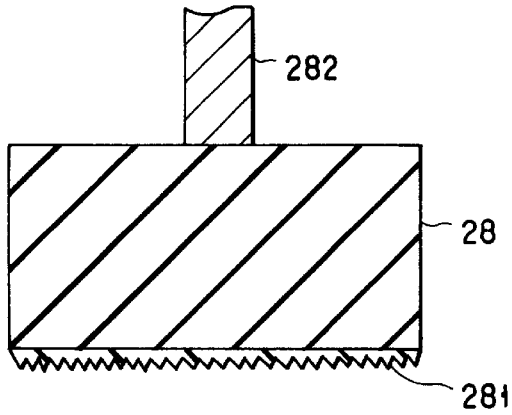

A diamond dresser 24 shown in FIG. 7B is, for example, a disc in which diamond particles 243 are incorporated into a resin. A dressing face 241 has exposed sharp tips of the diamond particles 243. The diamond dresser 24 is operated by a supporting arm 242 fixed on an opposite face to the dressing face 241. Instead of incorporating the diamond particles 243 into the resin, the diamond particles may be incorporated into a disc formed by Ni-electrodepositing. FIGS. 8A and 8B are discs which may be used instead of the diamond dresser illustrated in FIG. 7B, respectively. In the dresser shown in FIG. 8A, a thin layer 271 which is composed of silicon nitride or silicon carbide and has a thickness from 5 to 40 $\mu$m is deposited on a surface of a silicon nitride (SiN) substrate having a thickness from 5 to 10 mm by ECR (Electron Cyclotron Resonance)-CVD. The surface on which this thin layer is deposited is a dressing face. This dresser 27 is operated by a supporting arm 272 fixed on an opposite face to the dressing face. In a dresser 28 shown in FIG. 8B, a thin layer 281 which is composed of silicon nitride or silicon carbide and has a thickness from 5 to 40 $\mu$m is deposited on a surface of a silicon carbide (SiC) substrate having a thickness from 5 to 10 mm by ECR-CVD. The surface on which this thin layer is deposited is a dressing face.

This dresser 28 is operated by a supporting arm 282 fixed on an opposite face to the dressing face.

In the dressing method by using the above-mentioned dressers, dressing and polishing are repeated reciprocally (i.e. dressing→polishing→dressing→ . . .) in the dressing apparatus illustrated in FIG. 2.

Figure 9:
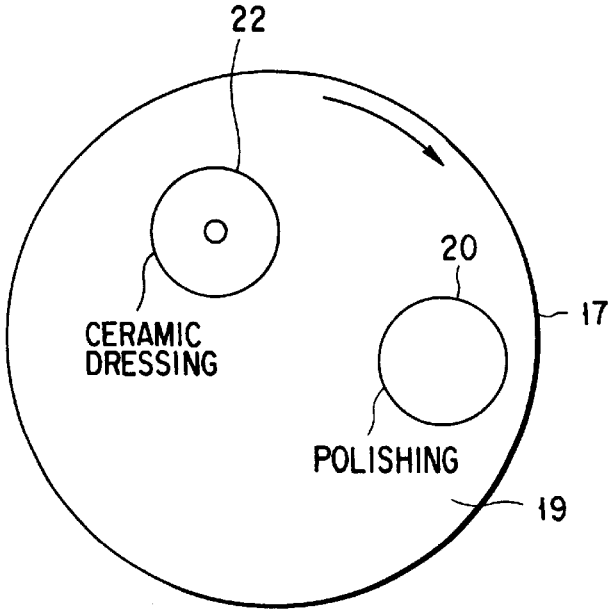
FIG. 9 is a plan view of a polishing apparatus for explaining the polishing method according to the invention.
Figure 10:
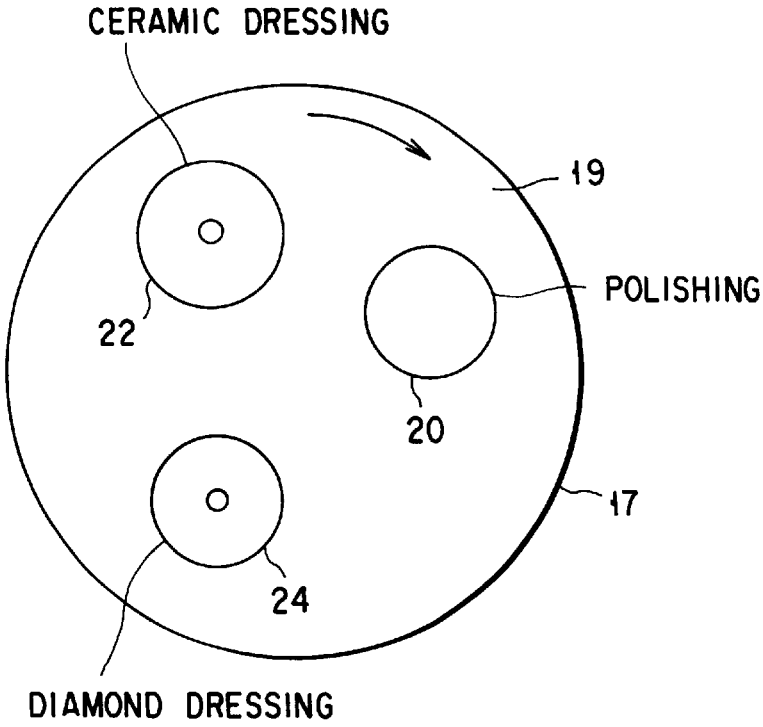
FIG. 10 is a plan view of a polishing apparatus for explaining the polishing method according to the invention.

The following will describe the third embodiment relating to a dressing method in which the dressing apparatus is used, referring to FIGS. 9 and 10. FIGS. 9 and 10 are plan views of the main portions of the dressing apparatus shown in FIG. 2, respectively. A polishing pad 9 is set up on a polishing plate 17 which can rotate at 100 rpm. During polishing, the number of rotation of the polishing plate 7 is usually from 20 to 200 rpm, and the pressure for pressing a silicon wafer 20 is usually from 50 to 500 g/cm$^2$, and preferably is about 350 g/cm$^2$. As shown in FIG. 9, the silicon wafer 20 is polished while it is pressed against the rotating polishing pad 19 at a given pressure. The polishing pad 18 is being dressed, during polishing the silicon wafer 20, by means of following the track of the silicon wafer 20 on the polishing pad 18 with use of a ceramic dresser 22 while pressing the ceramic dresser 22 against the polishing pad 18. The life time of the polishing pad becomes longer and the time for manufacturing a semiconductor apparatus is shortened because polishing and dressing are repeated for one silicon wafer by one silicone wafer.

Referring to FIGS. 11A and 11B–FIGS. 14A and 14B, the following will explain the state of a polishing pad to which the dressing treatment of the preset invention is applied.

Figure 11A:
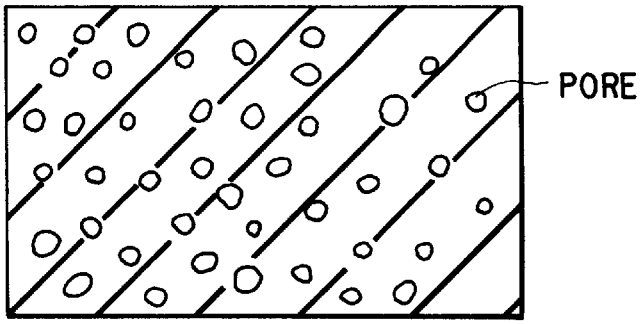
FIGS. 11A and 11B are enlarged cross section and plan view of a polishing pad for explaining the state of the polishing pad with which a semiconductor wafer is polished, respectively.
Figure 11B:
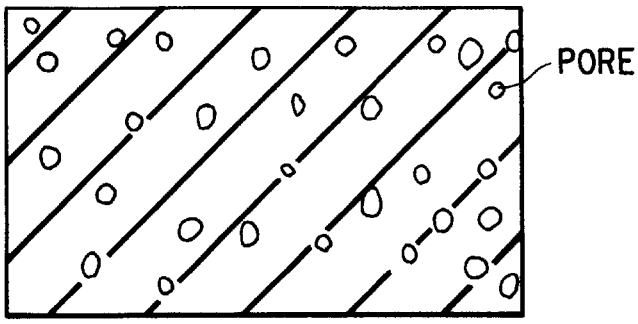
Figure 12A:
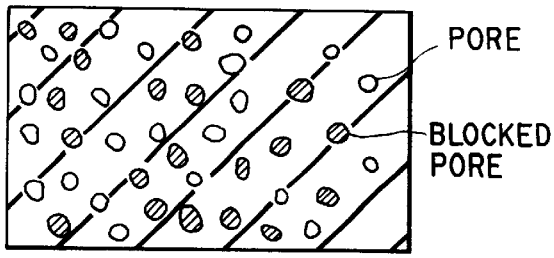
FIGS. 12A and 12B are enlarged cross section and plan view of a polishing pad for explaining the state of the polishing pad with which a semiconductor wafer is polished, respectively.
Figure 12B:
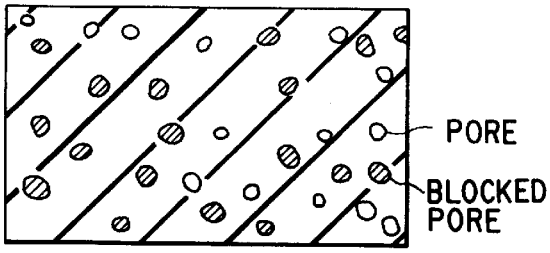
Figure 13A:
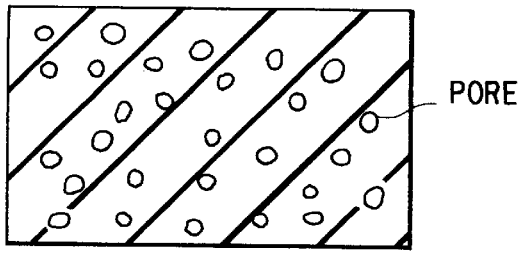
FIGS. 13A and 13B are enlarged cross section and plan view of a polishing pad for explaining the state of the polishing pad with which a semiconductor wafer is polished, respectively.
Figure 13B:
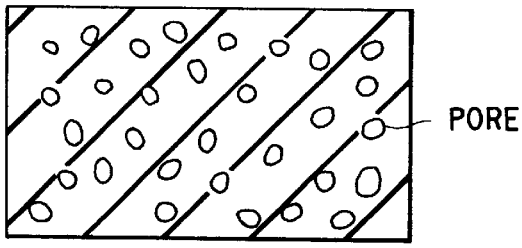
Figure 14A:
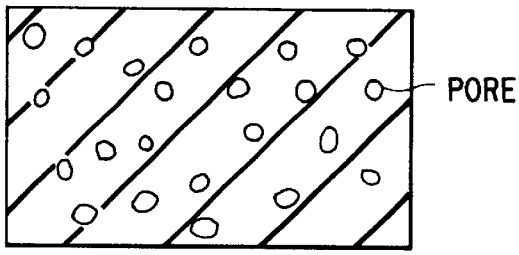
FIGS. 14A and 14B are enlarged cross section and plan view of a polishing pad for explaining the state of the polishing pad with which a semiconductor wafer is polished, respectively.
Figure 14B:
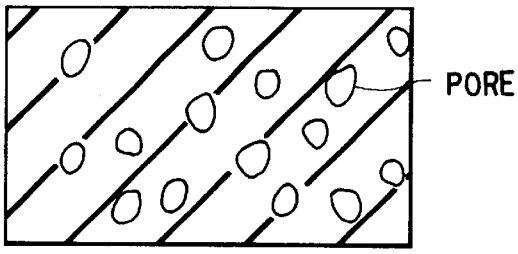

FIGS. 11A and 11B are enlarged plan view and cross section of a polishing pad which has not yet been used, respectively. FIGS. 12A and 12B, as well as FIGS. 13A and 13B, and FIGS. 14A and 14B, are enlarged plan view and cross section of the surface of a dressed polishing pad, respectively. As shown in FIGS. 11A and 11B, in the polishing pad made from a polyurethane foam, a pore layer is formed substantially uniformly and is active. When one or more semiconductor wafers are polished with the polishing pad shown in FIGS. 11A and 11B, reaction products and particles of a polishing material are pressed and confined into the interior of the pore layer, as shown in FIGS. 12A and 12B. Thus, many pores of the pore layer are blocked as shown by slanting lines in FIGS. 12A and 12B. As a result, in the polishing treatment the pore layer comes to have no room into which the polishing material is put, so that the polishing property is reduced. In the prior art as shown in FIGS. 13A and 13B, a polishing pad is restored to the same state as that of a virgin pad for a long time by diamond-dressing and dummy dressing (conditioning) of silicon wafers. FIGS. 14A and 14B illustrate the states after the polishing pad shown in FIGS. 12A and 12B is dressed with a ceramic dresser. The polishing pad is satisfactorily restored for a short time by only dressing treatment with the ceramic dresser.

The fourth embodiment will be described below, referring to FIGS. 15–18B.

Heretofore, there has been known a polishing method which enables to control dishing by polishing with use of a polishing pad of a polyurethane foam and with use of a polishing liquid in which a hydrophilic polysaccharide for forming a film on the surface of silicon is added into a polishing material.

Figure 15:
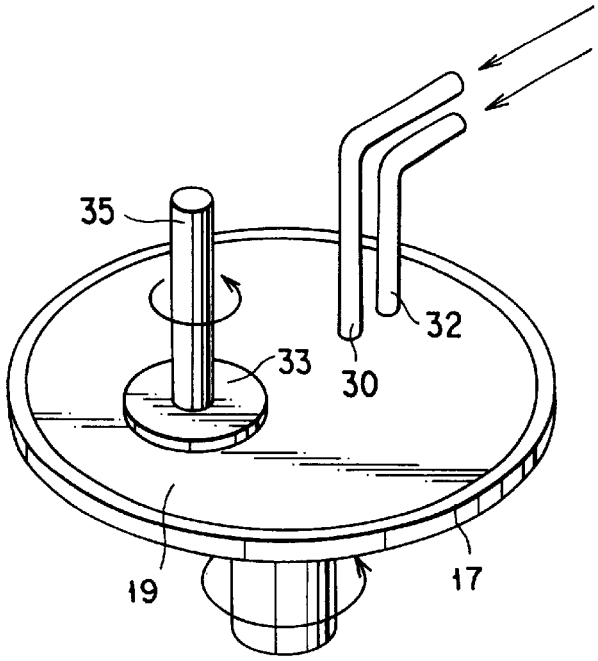
FIG. 15 is a partial perspective view of a polishing apparatus according to the invention.

FIG. 15 is a perspective view of a portion of a polishing apparatus which is used in this method. This polishing apparatus has a rotatable polishing plate 17 on which a polishing pad 19 is set up, in the same manner as in the polishing apparatus shown in FIG. 2. Above the polishing pad 19, there are disposed an adsorbing disc 33 which a silicon wafer is fixed on and which may be rotated by a driving shaft 35, a nozzle 30 for supplying a polishing material and a nozzle 32 for supplying an additive. The silicon wafer (not shown in FIG. 15) fixed on the adsorbing disc 33 is rotated, for example, under a condition that the polishing surface on which a polysilicon film is formed is pressed against the polishing pad 19 by pressure. At that time, a polishing material and an additive are added dropwise onto the polishing pad 19 from the nozzle 30 and the nozzle 32, respectively. The polishing material may be an alkaline solution containing polishing particles such as silica. The alkalne solution may be a material for chemically etching silicon, for example, an organic amine.

The additive includes cellulose such as hydroxyethyl cellulose, poly-saccharide, poly-vinyl pyrrolidone, and pyrrolidone. The amount of the additive is appropriately from 1 to 10 percentages by weight of the polishing material. A solvent for dissolving hydrophilic polysaccharide or the like includes ammonia and triethanol amine.

Figure 16:
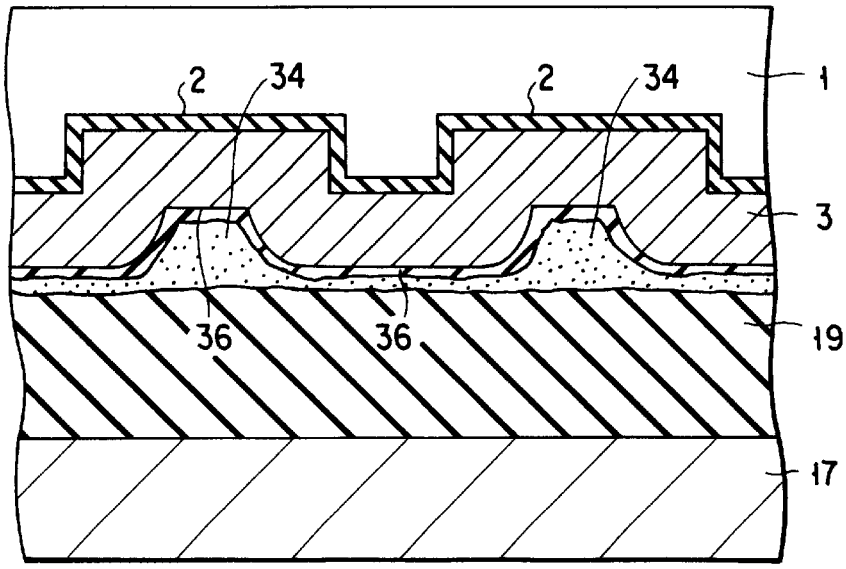
FIG. 16 is a cross section of a polishing pad in the polishing apparatus shown in FIG. 15 and a semiconductor wafer.
Figures 17, 18A, 18B:
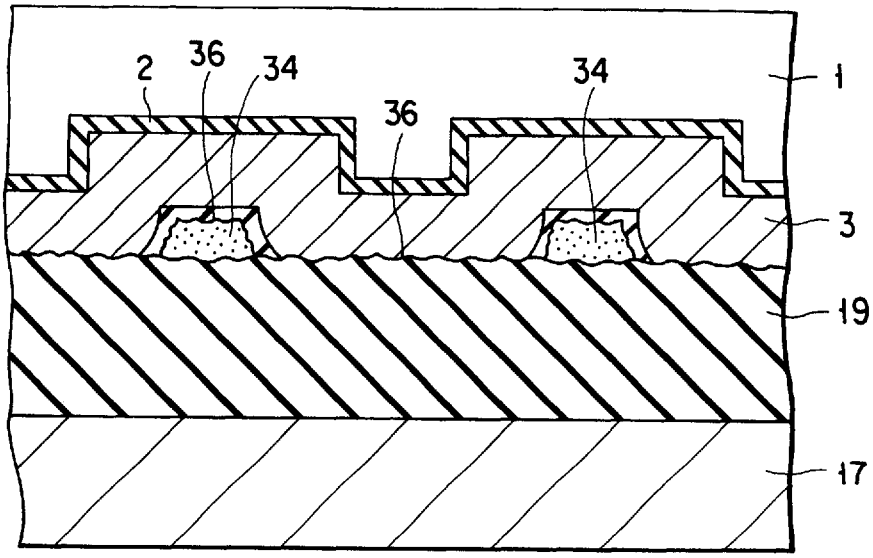
FIG. 17 is another cross section of a polishing pad in the polishing apparatus shown in FIG. 15 and a semiconductor wafer.
FIGS. 18A and 18B are diagrams for explaining the effect of the polishing method shown in FIG. 15, respectively.

FIGS. 16 and 17 are cross sections of a semiconductor substrate for explaining treatment for polishing a film to be polished of the semiconductor (e.g., silicon) substrate with a polishing pad.

A polishing material 34 into which an additive such as hydroxyethyl cellulose is added is being put into concave portions of a polysilicon film 3 formed on a silicon oxide film 2 on a semiconductor substrate 1, so that the polysilicon film 3 is being polished. At that time, hydroxyethyl cellulose adheres onto an uneven surface of the polysilicon film 3 so as to form a film 36. The film 36 is polished, from its convex portions, with the polishing pad 19 and polishing particles in the polishing material so as to be removed off. As a result, only convex portions of the polysilicon film 3 are exposed. The exposed portions of the polysilicon film 3 are polished with the polishing pad 19 and the polishing particles while being chemically etched with the alkaline solution. On the other hand, concave portions of the film 36 portions remain as they are so that with them the concave portions of the polysilicon film 3 are covered. The concave portions are protected from chemical etching with the alkaline solution by the concave cover portions of the film 36 portions.

In this embodiment, every time when one silicon wafer is polished, the silicon wafer is dressed with the ceramic dresser, which is a feature of the present invention. Either dresser shown in FIG. 7A or FIG. 7B may be used.

Next, the effect of this embodiment will be described, referring to FIGS. 18A and 18B.

Because the polishing pad is conditioned with the ceramic dresser in every time for treating one wafer, the polishing property of the pad can be maintained stablely. Dressing with the ceramic dresser makes it possible to control dishing than dressing with the diamond dresser, and to control dust adhesion on the semiconductor wafer resulted from dust-generation from the polishing pad than a process without any dressing process (FIG. 18A). Longer life time of the polishing pad and stability of the polishing rate can be also expected.

The additive, used in this embodiment, for forming a film on the surface of silicon is not limited to hydrophilic polysaccharide, and may be any material for preventing excess polishing. For example, a material for oxidizing the surface of silicon may be used.

Figure 19A:
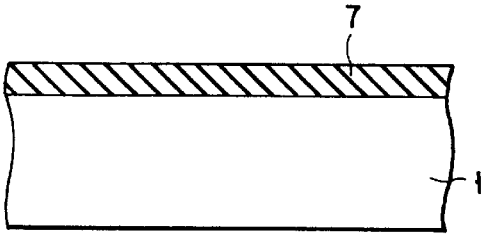
FIGS. 19A and 19B are cross sections of a structure of an apparatus used in a step in the present invention process for manufacturing a semiconductor apparatus, respectively.
Figure 19B:
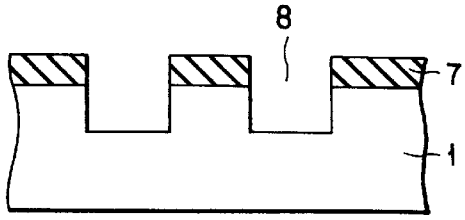
Figure 20A:
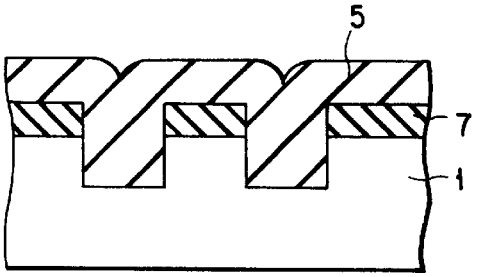
FIGS. 20A and 20B are cross sections of a structure of an apparatus used in a step in the present invention process for manufacturing a semiconductor apparatus, respectively.
Figure 20B:
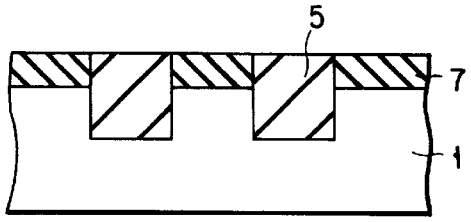

The following will explain the fifth embodiment relating to a treatment for flattening a $SiO_2$ surface film of a wafer treated in the polishing process using the polishing apparatus shown in FIG. 2, referring to FIGURES. At first, a $Si_3N_4$ film 7 is deposited on a semiconductor substrate 1 by, for example, CVD (FIG. 19A). Specified portions of the a $Si_3N_4$ film 7 and the semiconductor substrate 1 are then etched by patterning to form grooves 8 in these portions (FIG. 19B). A $SiO_2$ film 5 is deposited on the $Si_3N_4$ and in the grooves 8 by CVD (FIG. 20A). Subsequently, the $SiO_2$ film is polished by the CMP process. When the exposure of the $Si_3N_4$ film 7, which is a stopper film, is detected, the polishing treatment of the $SiO_2$ film 5 is stopped, thereby finishing to embed the $SiO_2$ film into the grooves 8 and making the surface of the semiconductor substrate 1 flat (FIG. 20B).

After one or more silicon wafers are subjected to this polishing treatment, the dressing treatment which is a feature of the present invention is applied to the polishing pad. This dressing treatment causes the polishing pad deteriorated by polishing the silicon wafers to be restored for a short time.

Figure 21A:
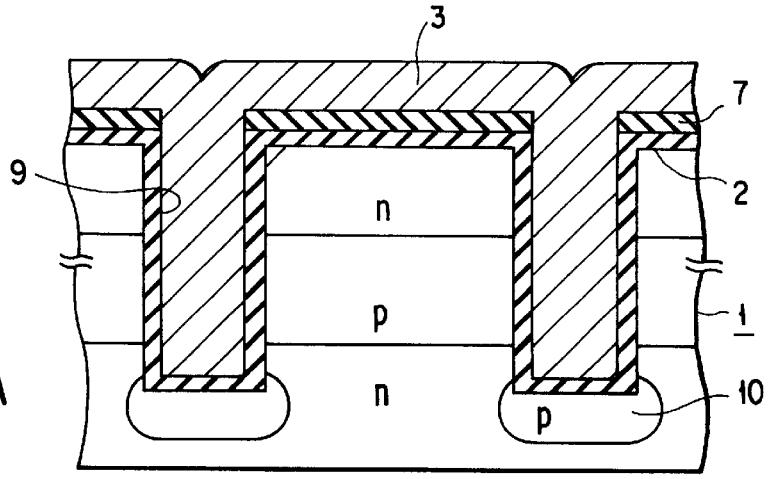
FIGS. 21A and 21B are cross sections of a structure of an apparatus used in a step in the present invention process for manufacturing a semiconductor apparatus, respectively.
Figure 21B:
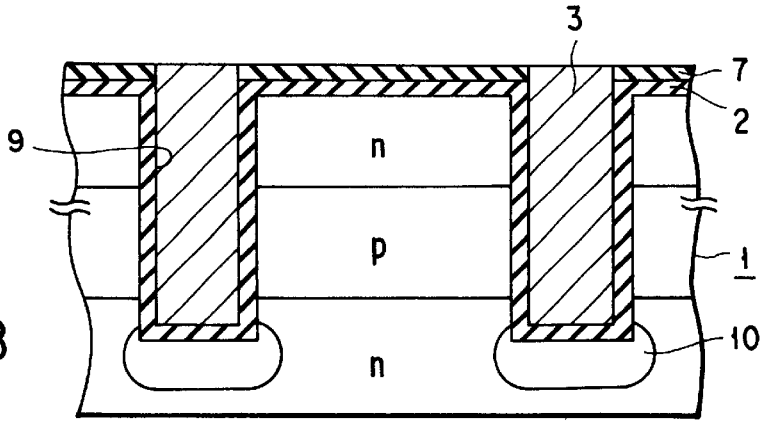

In recent years, the CMP method has been used in the manufacturing process of large-scale integrated devices. Thus, the following will explain the sixth embodiment relating to a process for manufacturing a large-scale integrated device, referring to FIGS. 21A and 21B. FIGS. 21A and 21B are cross sections of a structure of an apparatus used in the method of manufacturing a semiconductor device, to which the step of separating trench elements is applied. The surface of a semiconductor substrate 1 is oxidized by heat to form a $SiO_2$ film 2, and then a $Si_3N_4$ film 7, which is a stopper layer for stopping polishing, is deposited on the $SiO_2$ film by CVD. After that, parts of the $Si_3N_4$ film7, the $SiO_2$ film 2 and the semiconductor substrate 1, the parts being areas for forming elements separately, are removed off by lithographic patterning to form grooves 9. Subsequently, the surface of the semiconductor substrate 1 is oxidized within the grooves 9, and then boron is ion-implanted onto the bottom of the groove 9 to form channel cutting areas 10. A polysilicon film 3 is then deposited on the $Si_3N_4$ film 7 and in the grooves 9 by CVD (FIG. 21A). $SiO_2$ may be used instead of the polysilicon film.

Next, the polysilicon film 3 on the surface of the semiconductor substrate 1 is polished until the $Si_3N_4$ film 7 is exposed (FIG. 21B). The polishing rate of the $Si_3N_4$ film 7 is about from one-tenth to one-two hundredth as low as that of the polysilicon film and consequently the polishing treatment can be stopped by the $Si_3N_4$ film 7, so that the polysilicon film 3 can be embedded only in the grooves.

As described above, a layer whose polishing rate is smaller than a layer to be polished can be selected as the stopper film for stopping polishing, and the polishing time can be specified. Thus, the polishing treatment can be stopped when the stopper film is exposed.

After one or more silicon wafers are subjected to this polishing treatment, the dressing treatment which is a feature of the present invention is applied to the polishing pad. This dressing treatment causes the polishing pad deteriorated by polishing the silicon wafers to be restored for a short time.

Referring to FIGS. 22A to 22C, and FIGS. 23A and 23B, the seventh embodiment will be described which relates to a polishing process used in the case of embedding a metallic wiring into grooves of an insulated film.

Figure 22A:
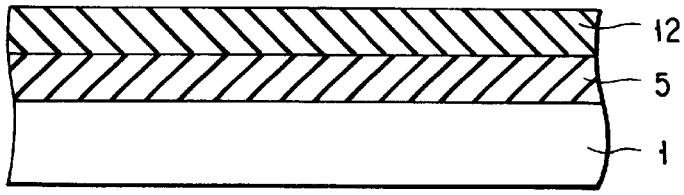
FIGS. 22A to 22C are cross sections of a structure of an apparatus used in a step in the present invention process for manufacturing a semiconductor apparatus, respectively.
Figure 22B:
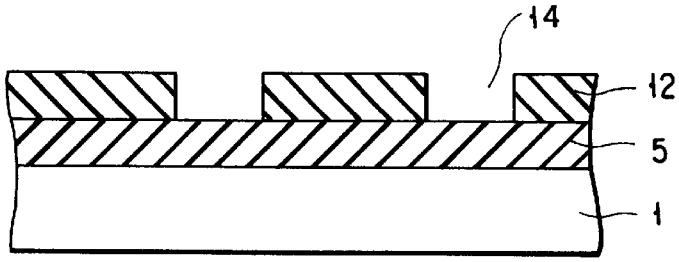
Figure 22C:
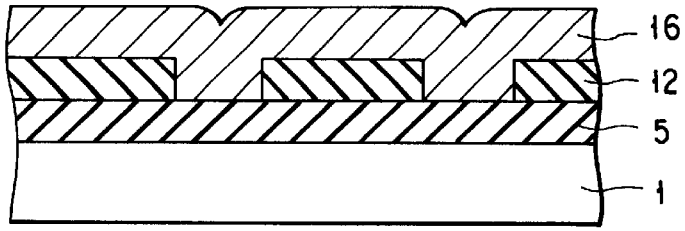
Figure 23A:
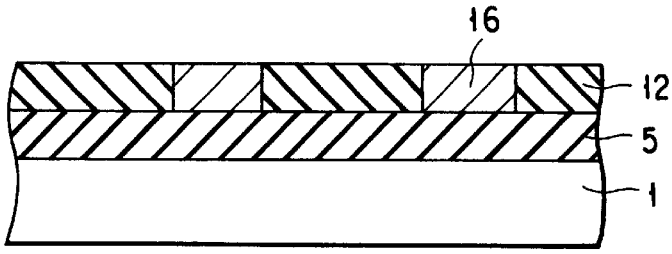
FIGS. 23A and 23B are cross sections of a structure of an apparatus used in a step in the present invention process for manufacturing a semiconductor apparatus, respectively.

A $SiO_2$ film 5 and a plasma $SiO_2$ film 12 are deposited on a semiconductor substrate 1 in sequence by CVD (FIG. 22A). Specified portions of the plasma $SiO_2$ film 12 are then patterned to form grooves 14 (FIG. 22B). A Cu film 16 is deposited into the grooves 14 and on the whole surface of the plasma $SiO_2$ film 12 (FIG. 22C). The Cu film 16 is polished, with use of the plasma $SiO_2$ film 12 as a stopper film. When the plasma $SiO_2$ film is exposed, the polishing treatment of the Cu film 16 is stopped, so that the Cu film 16 is embedded only in the grooves 14 to form a Cu embedded wiring (FIG. 23A).

Figure 23B:
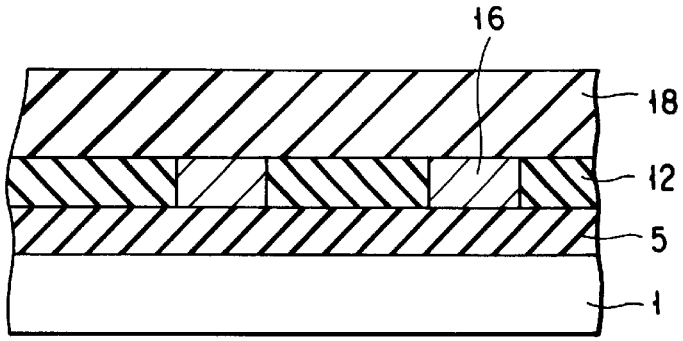

This polishing makes the surface of the semiconductor substrate 1 flat, and consequently the formation of the subsequent, second plasma $SiO_2$ film is easy (FIG. 23B). Because of the flatness according to CMP process, the formation of electrode wiring (not shown) of second film and third film will be easy.

After one or more silicon wafers are subjected to this polishing treatment, the dressing treatment which is a feature of the present invention is applied to the polishing pad. This dressing treatment causes the polishing pad deteriorated by polishing the silicon wafers to be restored for a short time.

According to the present invention as set forth above, (1) it is possible to remove off reaction products with which the interior of the pore layer of the polishing pad is blocked and impurities which are pressed and confined in the pores, such as polishing particles, and remove off the pore layer made rough. (2) The condition of the regenerated or restored surface of the polishing pad is substantially the same as that after being conditioned, thereby enabling the next polishing treatment without conditioning. (3) When the dressing treatment with the ceramic dresser according to the invention is conducted after or accompanied with polishing treatment, it is possible to obtain a stable polishing rate and uniformity from polishing. (4) By adding an additive for forming a film preventing excess polishing into the polishing material, it is possible to reduce dust with dishing being controlled, make the life time of the polishing pad longer, and maintain the stability of the polishing rate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for dressing a polishing pad, comprising the steps of:

polishing at least one semiconductor wafer, in which a polishing material containing polishing particles is applied to a polishing surface of the polishing pad while the one semiconductor wafer is polished with the polished pad;

dressing, after said polishing step, the surface of the polishing pad deteriorated by polishing the semiconductor wafer, with a ceramic dresser;

dressing the polishing pad again with the ceramic dresser, after the deteriorated polishing pad dressed by using the ceramic dresser is again deteriorated by polishing another semiconductor wafer; and dressing the polishing pad with a diamond dresser, after conducting the above-mentioned dressing step with the ceramic dresser a plurality of times.

2. The method for dressing a polishing pad according to claim 1, wherein the polishing pad dressed with the diamond dresser is dressed with the ceramic dresser, before the polishing pad is used for a further polishing treatment.

3. The method for dressing a polishing pad according to claim 1, wherein the surface of the ceramic dresser has at least one step portion.

4. A method for dressing a polishing pad, comprising the steps of:

dressing a used surface of the polishing pad with a diamond dresser;

dressing, after said dressing step with the diamond dresser, with a ceramic dresser the surface of the polishing pad treated with the diamond dresser;

polishing, after said dressing step with the ceramic dresser, at least one semiconductor wafer, in which a polishing material containing polishing particles is applied to a polishing surface of the polishing pad while the one semiconductor wafer is polished with the polishing pad; and dressing, after said polishing step, the surface of the polishing pad deteriorated by polishing the semiconductor wafer, with the ceramic dresser.

5. The method for dressing a polishing pad according to claim 4, which further comprises the step of dressing the polished pad again with the ceramic dresser, after the deteriorated polishing pad dressedly using the ceramic dresser is again deteriorated by polishing another semiconductor wafer.

6. The method for dressing a polishing pad according to claim 4, wherein the surface of the ceramic dresser has at least one step portion.

* * * * *